US005376018A

United States Patent [19]

Davis et al.

[11] Patent Number: 5,376,018

[45] Date of Patent: Dec. 27, 1994

[54] HIGH-DENSITY CABLE CONNECTOR

[75] Inventors: Wayne S. Davis, Harrisburg; Robert N. Whiteman, Jr., Middletown, both of Pa.

[73] Assignee: The Whitaker Corporation, Wilmington, Del.

[21] Appl. No.: 172,001

[22] Filed: Dec. 22, 1993

Related U.S. Application Data

[63] Continuation-in-part of Ser. No. 955,554, Oct. 1, 1992, abandoned.

[51] Int. Cl.[5] ..... H01R 4/24

[52] U.S. Cl. ..... 439/405; 439/395; 439/404

[58] Field of Search ..... 439/389, 404, 405, 406, 439/407, 395, 396, 397, 398, 399, 400

[56] References Cited

U.S. PATENT DOCUMENTS

| | | | |
|---|---|---|---|
| 4,260,212 | 4/1981 | Ritchie et al. | 339/97 R |
| 4,288,141 | 9/1981 | Leather | 339/97 R |
| 4,639,056 | 1/1987 | Lindeman et al. | 339/17 LC |
| 4,781,615 | 11/1988 | Davis et al. | 439/395 |
| 4,802,860 | 2/1989 | Kikuta | 439/79 |
| 4,995,828 | 2/1991 | Goodman et al. | 439/405 |
| 5,041,007 | 8/1991 | Liu et al. | 439/404 |
| 5,062,805 | 11/1991 | Liu et al. | 439/404 |
| 5,064,391 | 11/1991 | Buchter | 439/733 |
| 5,079,827 | 1/1992 | Meyer | 29/566.3 |
| 5,118,306 | 6/1992 | Bixler et al. | 439/405 |

*Primary Examiner*—William Briggs

[57] ABSTRACT

The upstanding terminating portion (12) of a contact (10) has respective cut-outs forming respective laterally-extending ears (13) on respective sides of the elongated body (11) of the contact (10). The bottom surfaces (14) of the ears (13) are thus elevated above the plane (15) of the top surfaces (16) of the contacts (10). As a result, the contacts (10) may be spaced closer together (Y) for a higher circuit density. Moreover, the ears (13) are supported on respective ledges (19) formed in the insulated connector housing (17); this assures that the terminating portion (12) of each contact (10) will not move during the wire-terminating operation.

4 Claims, 6 Drawing Sheets

HIGH-DENSITY CABLE CONNECTOR

CROSS REFERENCE TO RELATED APPLICATION

The present application is a continuation-in-part of application Ser. No. 07/955,554 filed Oct. 1, 1992, now abandoned, the disclosure of which is incorporated in its entirety by reference herein.

FIELD OF THE INVENTION

The present invention relates to electrical connectors and, in particular, to a high-density cable connector for terminating multiple insulated wires or conductors.

BRIEF DESCRIPTION OF THE INVENTION

In my U.S. Pat. No. 4,781,615, Davis et al, issued on Nov. 1, 1988 and assigned to the assignee of the present invention, an electrical connector assembly is therein disclosed and claimed for terminating a cable having a plurality of insulated conductors or wires disposed in a substantially flat planar array. These insulated wires are connected to a corresponding plurality of contacts retained within a dielectric housing which provides an insulated support for the contacts. Each contact has an elongated body and further has a terminating portion at one end of the body and extending substantially at right angles thereto. Each terminating portion has a slot for receiving a respective insulated wire. As the wire is shoved into the slot in the terminating portion of the contact, the terminating portion slices through the insulation on the wire, thereby making electrical engagement thereto and effecting a wire-termination operation.

The termination portion of each contact has a larger width than the elongated body portion thereof. Preferably, the adjacent contacts are staggered longitudinally with respect to each other, such that the terminating portion of one contact is disposed laterally of the elongated body portion of an adjacent contact, thereby reducing the transverse spacing between adjacent contacts. This arrangement provides for a higher circuit density for product miniaturization; even with this arrangement, however, there is a finite limit to the close spacing between adjacent contacts because of dielectric considerations.

Moreover, and because of manufacturing considerations, the terminating portion of each contact is joined to its elongated body portion through an intermediate portion having a slight radius. As a result, the terminating portion tends to move backwards (somewhat) as the insulated wire is shoved into the slot in the terminating portion during the automated wire-termination operation. This movement of the terminating portion of the contact during the wire termination operation must be taken into account, thereby further limiting the desired close spacing of the respective contacts during the initial design thereof.

SUMMARY OF THE INVENTION

Accordingly, it is the basic object of the present invention to effect a still further close spacing between the adjacent contacts for an even greater circuit density, yet accommodate both dielectric and manufacturing considerations.

In accordance with the teachings of the present invention, the terminating portion of each contact has a pair of cut-outs, one on each side of the elongated body of the contact, such that a pair of laterally-extending ears is formed on each terminating portion. Each of these ears has a bottom surface which is elevated above the given plane of the respective top surfaces of the elongated bodies of the respective contacts. As a result, the respective adjacent contacts are moved closer together for an increased circuit density.

Moreover, the insulated support has respective ledges upon which the bottom surfaces of the ears are supported, thereby providing superior dielectric qualities, and thereby preventing the terminating portions of the respective contacts from moving during the wire termination operation, especially since the terminating portion is integrally joined to the elongated body of the contact by an intermediate portion having a slight radius.

In a preferred embodiment, the conductor comprises an insulated wire, and the terminating portion of each contact has a slot into which the insulated wire is inserted, such that the terminating portion slices through the insulation on the wire and makes electrical engagement during the wire-termination operation.

GENERAL DESCRIPTION OF THE PREFERRED EMBODIMENT

Figure 1:
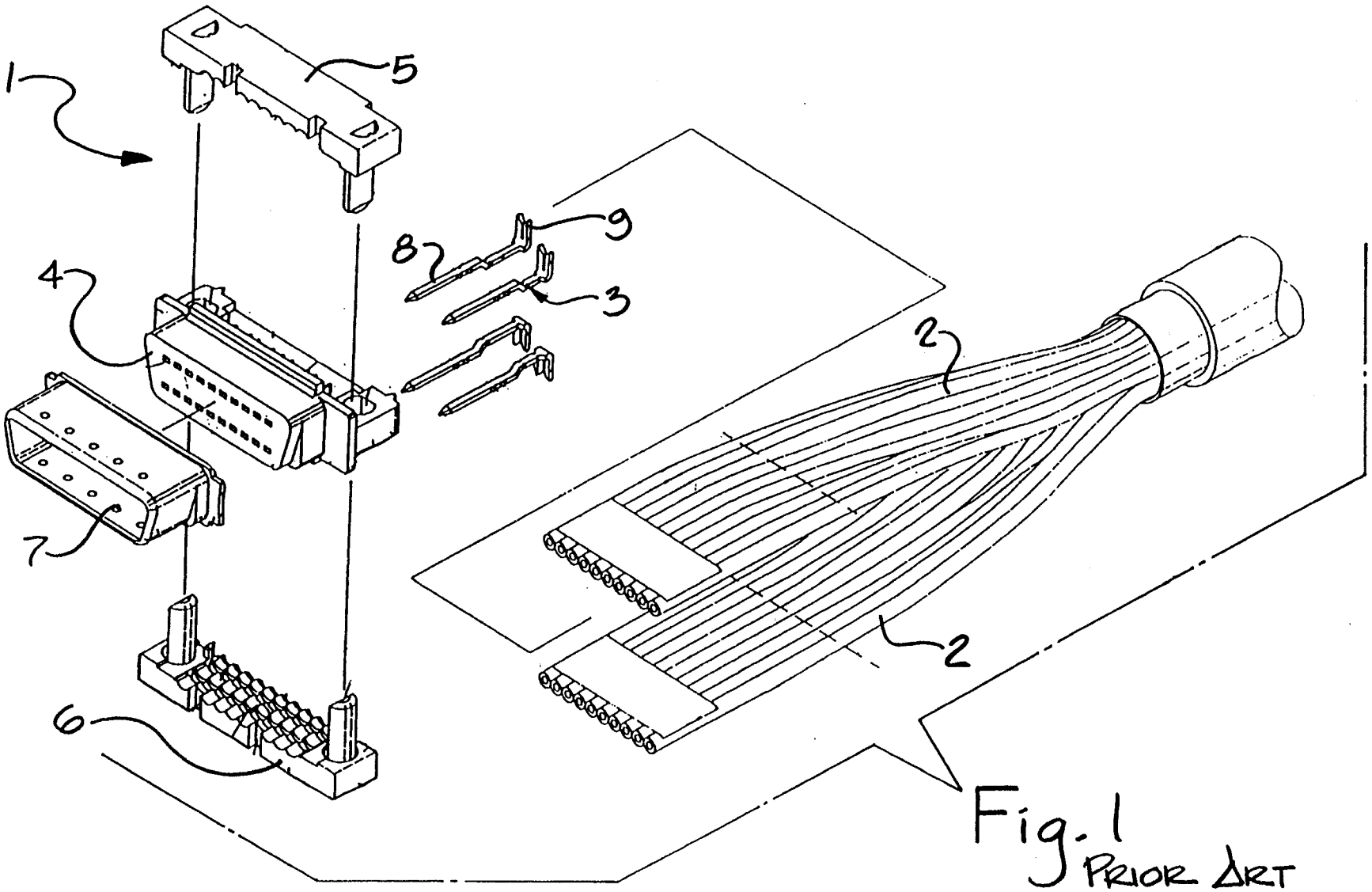
Fig. 1 PRIOR ART
FIG. 1 is an exploded perspective view of a prior art cable terminating cover retention system which is exemplary of the electrical connectors within which the teachings of the present invention may be employed.
Figure 6:
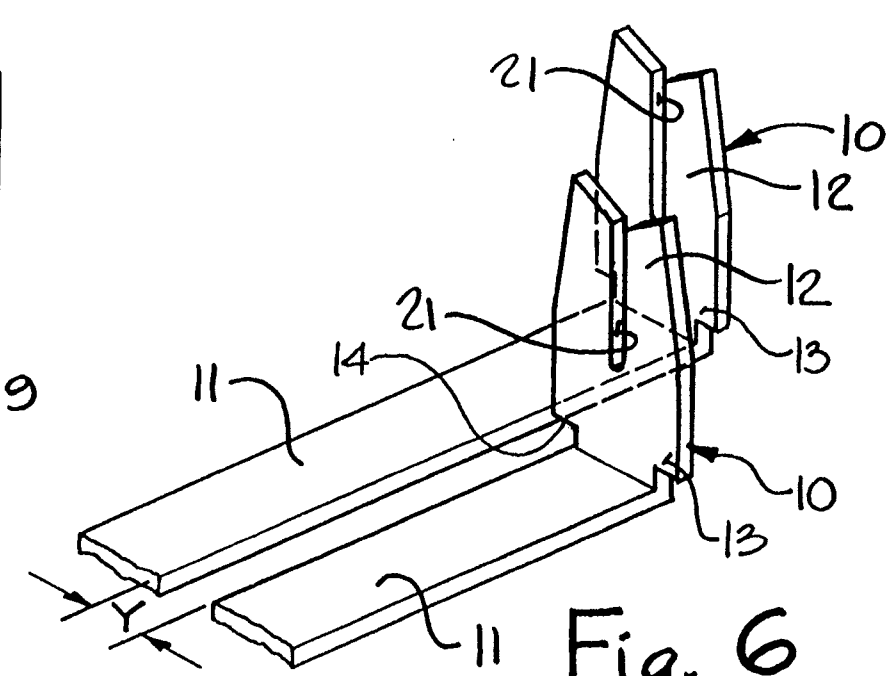
FIG. 6 is a perspective view of a pair of adjacent contacts of the present invention, showing how an even closer spacing is effected for a higher circuit density in a given connector system.
Figure 2:
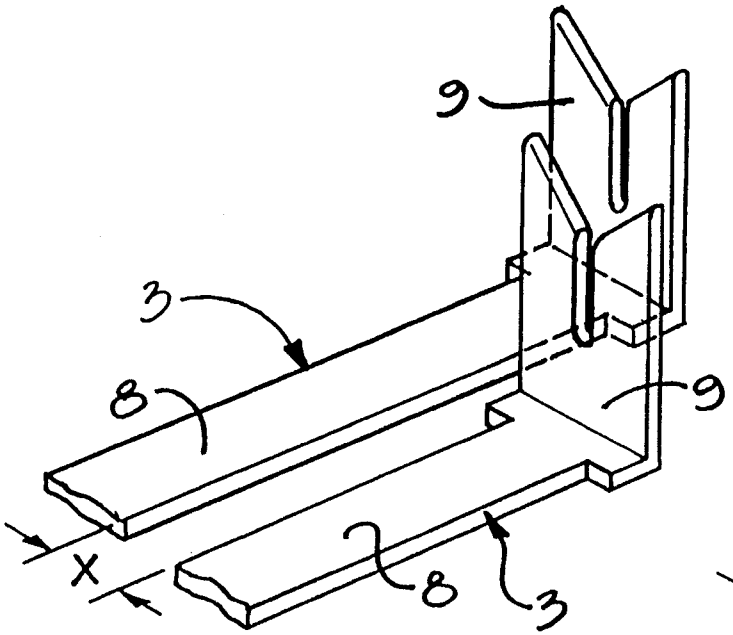
Fig. 2 PRIOR ART
FIG. 2 is a perspective view (somewhat schematic) of a pair of prior art contacts, such as those used in the retention system of FIG. 1, showing the longitudinally-staggered arrangement between respective adjacent contacts, each of which has an enlarged terminating portion integrally joined to an elongated body substantially at right angles thereto.

The teachings of the present invention may be used in the prior art cable terminating cover retention system 1 shown in FIG. 1. This retention system 1 is disclosed and claimed in the aforementioned Davis et al '615 patent.

In this retention system 1, a plurality of wires or conductors 2 are arranged in respective substantially-flat planar arrays for connection to a corresponding plurality of contacts 3. These contacts 3 are mounted within respective contact-receiving passages in an insulated plug housing 4. The plug housing 4 has an upper terminating cover 5 and a lower terminating cover 6 (which snap together) and a shroud or shell 7 is fitted over the plug housing 4.

A pair of adjacent contacts 3 is illustrated schematically in FIGS. 2–5. Each contact 3 has an elongated body portion 8 and an upstanding terminating portion 9 substantially at right angles thereto. The transverse distance or spacing between the adjacent elongated body portions 8 of a pair of these prior art contacts 3 is denoted by X.

It will be appreciated by those skilled in the art, however, that the retention system 1 of FIG. 1 (as well as the particular contacts 3 of FIGS. 2–5) are only exemplary of retention systems, connectors and respective contacts and terminals with which the disclosure and teachings of the present invention may be employed.

With this in mind, and with reference to FIGS. 6–9, each conductive contact 10 of the present invention has an elongated narrow body 11 and a wider terminating portion 12; and the terminating portion 12 has a pair of cut-outs to form laterally-extending ears 13, one on each side of the elongated body 11. As a result, and as shown more clearly in FIG. 9, the bottom surfaces 14 of the respective ears 13 are raised or elevated by a distance above the given plane 15 of the top surfaces 16 of the elongated bodies 11 of the respective contacts 10. With this arrangement, the respective elongated bodies 11 are spaced closer together as denoted by Y in FIG. 7.

Figure 3:
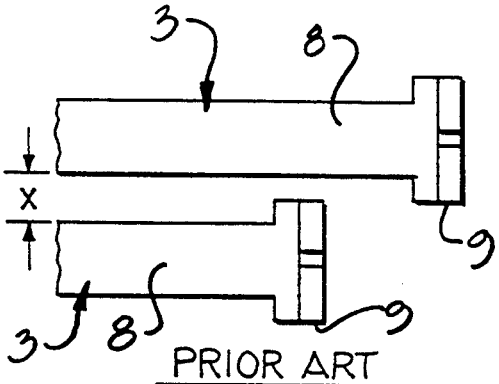
PRIOR ART Fig. 3
FIG. 3 is a top plan view thereof, the transverse spacing between adjacent contacts being denoted by X.
Figure 7:
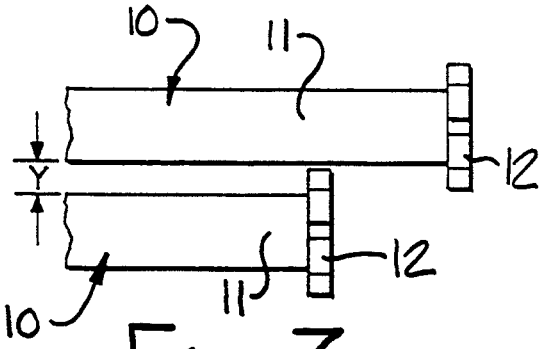
FIG. 7 is a top plan view thereof, showing the transverse spacing (denoted as Y) wherein Y is less then X (of FIGS. 2–5).
Figure 4:
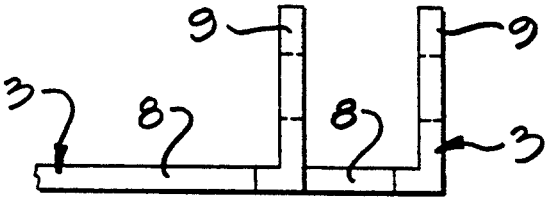
PRIOR ART Fig. 4
FIG. 4 is a side elevational view thereof.
Figure 8:
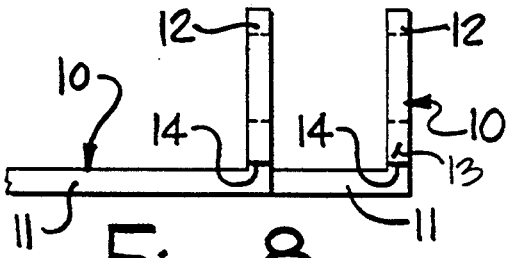
FIG. 8 is a side elevational view thereof.
Figure 5:
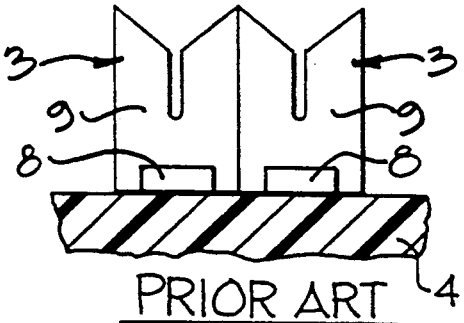
PRIOR ART Fig. 5
FIG. 5 is an end view thereof, showing the dielectric material of the insulated support.
Figure 9:
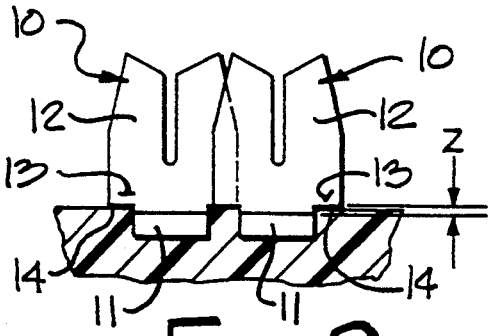
FIG. 9 is an end view thereof, showing the laterally-extending ears formed by respective cut-outs on the terminating portion of each contact, and further showing the ledges in the insulated connector for supporting the respective ears on the terminating portion of each contact.
Figure 10:
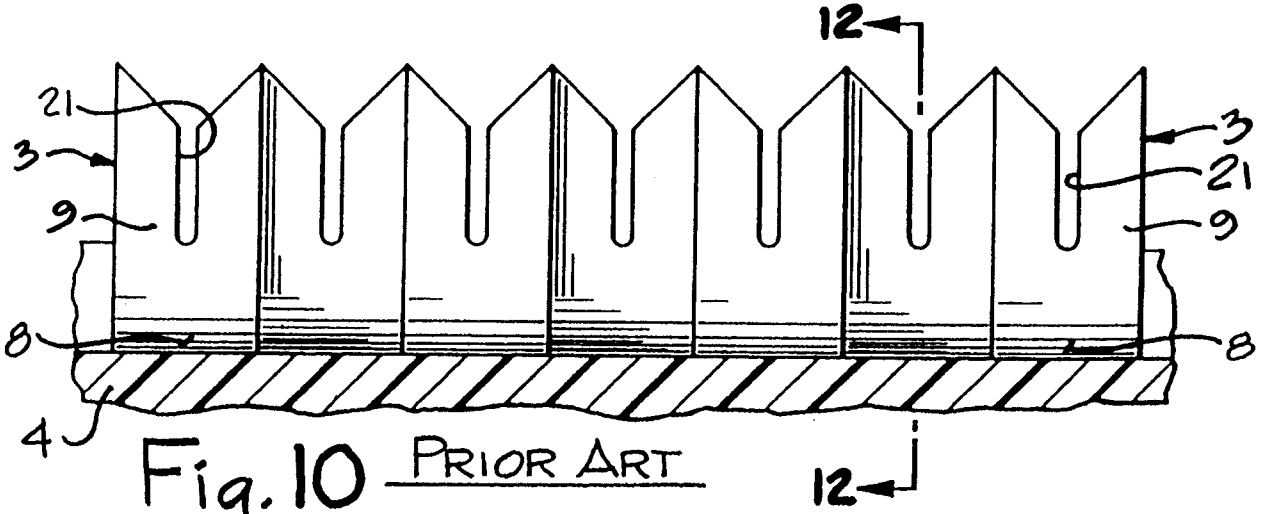
Fig. 10 PRIOR ART
FIG. 10 is an end view of a typical connector, showing the adjacent contacts of the prior art.
Figure 11:
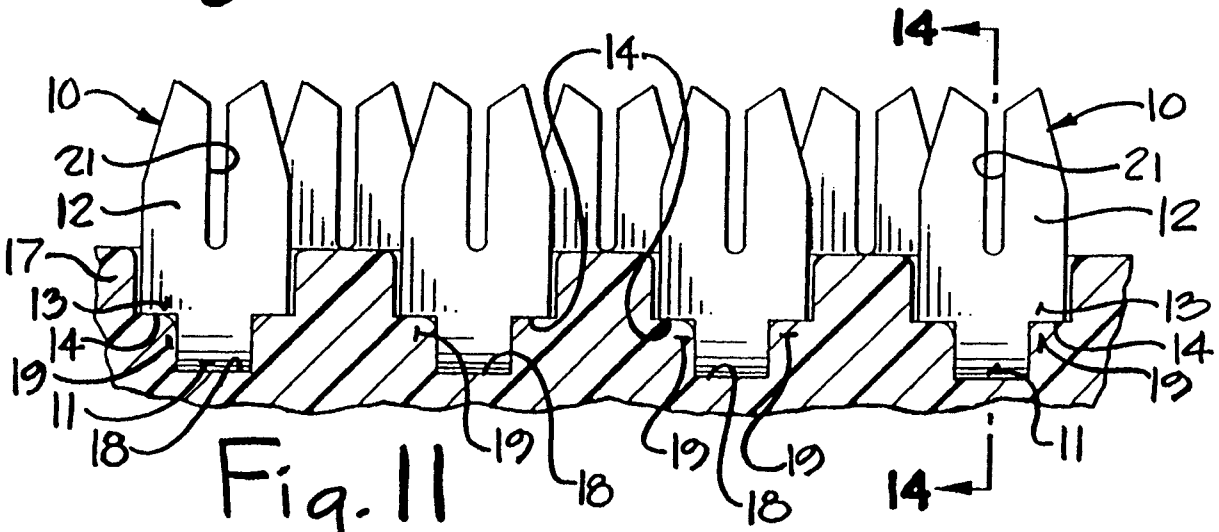
FIG. 11 is an end view of a connector using the improvement of the present invention, further illustrating the closer contact spacing.
Figure 13:
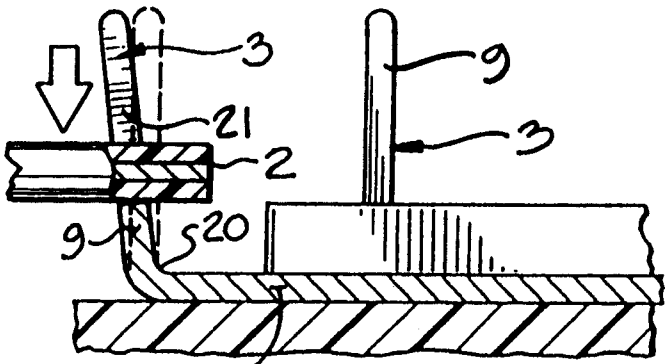
Fig. 13 PRIOR ART
FIG. 13 is a further section view, corresponding substantially to that of FIG. 12, but showing how the terminating portion of each contact is slightly depressed (or sags) during the wire-termination operation.
Figure 12:
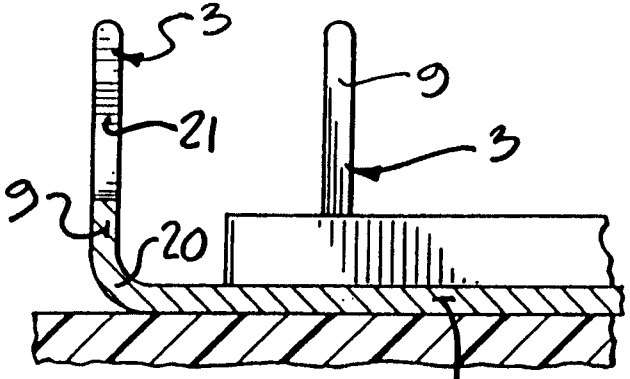
Fig. 12 PRIOR ART
FIG. 12 is a section view, taken along the lines 12—12 of FIG. 10, showing the prior art contact arrangement, and further showing an intermediate portion joining the terminating portion to the body portion of each contact, the intermediate portion having a slight radius.
Figure 15:
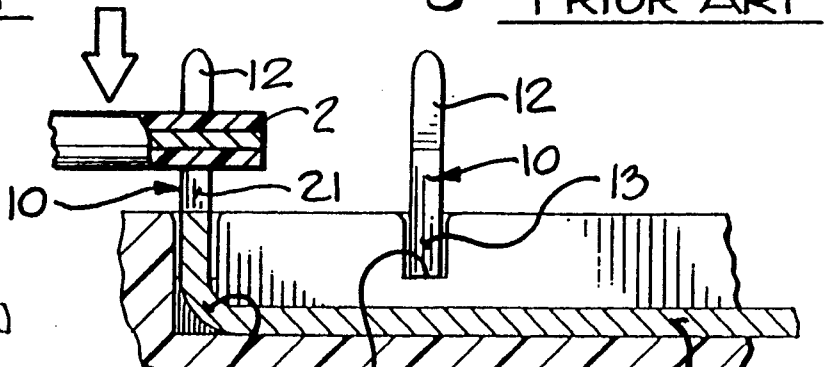
FIG. 15 is a further cross-sectional view, corresponding substantially to FIG. 14, but illustrating how the terminating portion of each contact is fully supported (by the respective ledges within the insulated support) such that the terminating portion will not sag or move during the wire-terminating operation.
Figure 14:
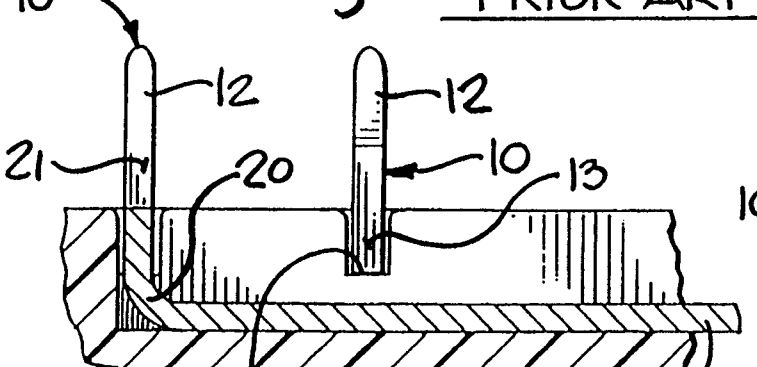
FIG. 14 is a further cross-sectional view, taken across the lines 14—14 of FIG. 11 and corresponding substantially to FIG. 12, but illustrating the improved contacts of the present invention.

Comparing FIGS. 3 and 7, the distance Y for the contacts 10 is less than the distance X for the prior art contacts 3. Accordingly, and with further reference to FIGS. 10 and 11, a greater number of contacts 10 may be mounted within a given insulated support or connector housing 17 for a greater circuit density. Conversely, a given number of contacts 10 may be mounted within a smaller housing 17 for improved product miniaturization.

With reference again to FIG. 11, the connector housing 17 has a plurality of longitudinal spaced-apart parallel grooves 18 for supporting the corresponding plurality of elongated bodies 11 of the respective contacts 10 (as in the prior art).

However, of significance, the connector housing 17 further has a plurality of ledges 19 which support the respective ears 13 on the terminating portions 12 of the respective contacts 10. Supporting the ears 13 on the ledges 19 has two advantages: first, improved dielectric qualities and, second, support during the wire-termination operation.

The latter advantage is illustrated in FIGS. 12–15. For manufacturing reasons, the respective terminating portions (9, 12) for the respective contacts (3, 10) are integrally joined to the respective elongated bodies (8, 11) by an intermediate portion 20 having a slight radius. As a result, when the wire 2 is inserted into the slot 21 in the terminating portion 9 of the prior art contact 3 (FIG. 12), the terminating portion 9 tends to move backwards or flex about the radius portion 20.

However, and with reference again to FIGS. 14 and 15, the terminating portion 12 of the contact 10 does not move as the wire 2 is inserted into the slot 21 in the terminating portion 12, since the wider portions of the contacts 10, namely the ears 13 are fully supported on the respective ledges 19 that are elevated with respect to the portions 20 and the bodies 11. Accordingly, the very close spacing Y between the narrow bodies 11 of the improved contacts 10 of the present invention may be maintained. The wider terminating portions 12 of adjacent bodies 11 overlap and are offset with respect to each other from front to rear to prevent engagement therebetween. This is another feature and advantage of the present invention, heretofore not available in the prior art.

Figure 16:
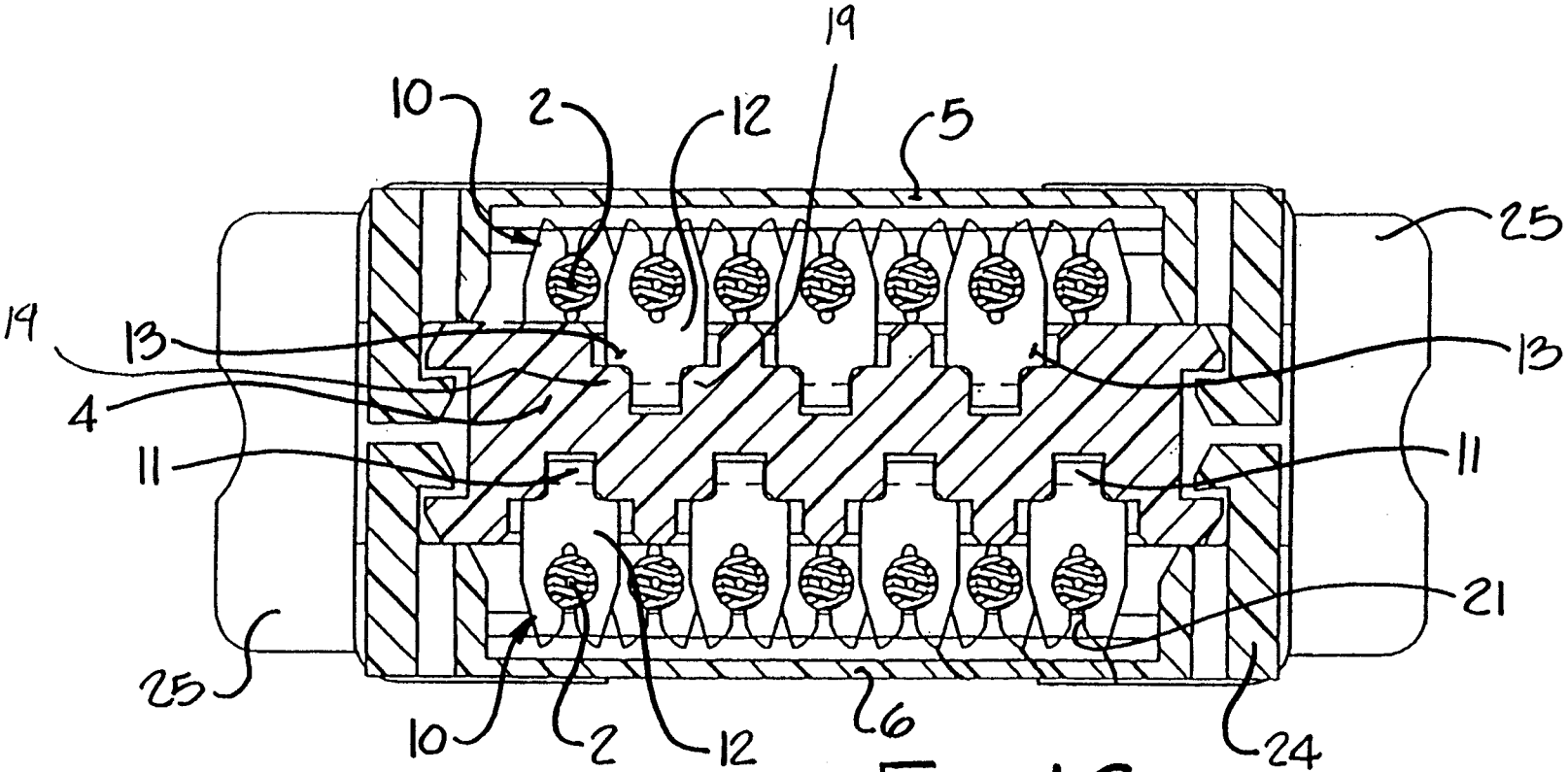
FIG. 16 is a cross-sectional view, showing the teachings of the present invention applied to a typical connector having multiple contacts arranged in a pair of respective rows.

The complete assembly 22 is shown in FIG. 16. There, the grooves 18 and the ledges 19 for the respective elongated bodies 11 and the ears 13 (of the contacts 10) are formed in an insulating terminal support block 23 which carries the upper and lower terminating covers 5 and 6, respectively. The terminating support block 23 and the respective covers 5, 6 are mounted within a panel 24 having a flange 25. It will be appreciated by those skilled in the art, however, that the teachings of the present invention are not confined thereto but, rather, are equally applicable to a wide variety of connectors and cable terminating systems.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In an electrical connector including an insulated support and further including a plurality of substantially parallel spaced-apart contacts, wherein each contact has an elongated body longitudinally of the contact, wherein each contact further has a terminating portion formed integrally with the body of the contact at one end thereof and extending above and substantially at right angles thereto, such that a conductor may be joined with the terminating portion of the contact during a conductor-termination operation, wherein the elongated bodies of the contacts have respective top surfaces lying substantially in a given plane, and wherein adjacent respective contacts are staggered longitudinally thereof, the improvement wherein the terminating portion of each contact has a pair of cutouts, one on each side of the elongated body of the contact, such that a pair of laterally-extending ears is formed on each terminating portion, each of the ears having a bottom surface which is elevated above and generally parallel to the plane of the respective top surfaces of the elongated bodies of the respective contacts, such that the respective adjacent contacts are moved closer together for an increased circuit density, and the insulated support having respective ledges upon which the bottom surfaces of the ears are supported, thereby providing superior dielectric qualities, and thereby substantially preventing the terminating portions of the respective contacts from moving during the conductor-termination operation.

2. The improvement of claim 1, wherein each of the wire-terminating portions has a width which is larger than the width of the elongated body of the respective contact.

3. The improvement of claim 2, wherein the terminating portion is integrally joined at the elongated body of the contact by an intermediate portion having a slight radius.

4. The improvement of claim 3, wherein the conductor comprises an insulated wire, and wherein the terminating portion of each contact has a slot into which the insulated wire is inserted, such that the terminating portion slices through the insulation on the wire and makes electrical engagement therewith in a wire-termination operation.

* * * * *